US008961210B2

(12) United States Patent
Joe et al.

(10) Patent No.: US 8,961,210 B2
(45) Date of Patent: Feb. 24, 2015

(54) LOCKABLE ELECTRICAL CONNECTOR

(75) Inventors: Steven Joe, Coto de Caza, CA (US); Young Wen, Irvine, CA (US); Shawn Rogers, Anaheim, CA (US)

(73) Assignee: Zyxel Communications, Inc., Anaheim, CA (US)

( * ) Notice: Subject to any disclaimer, the term of this patent is extended or adjusted under 35 U.S.C. 154(b) by 38 days.

(21) Appl. No.: 13/364,052

(22) Filed: Feb. 1, 2012

(65) Prior Publication Data

US 2013/0196527 A1 Aug. 1, 2013

(51) Int. Cl.
*H01R 13/62* (2006.01)

(52) U.S. Cl.
USPC ..... 439/304; 438/372

(58) Field of Classification Search
CPC ..... H01R 35/04; H01R 13/6397
USPC ..... 439/133, 676, 541.5, 352, 353, 354, 439/304, 372
See application file for complete search history.

(56) References Cited

U.S. PATENT DOCUMENTS 3,784,959 A * 1/1974 Horton ..... 439/275
5,010,426 A * 4/1991 Krenz ..... 360/99.15
5,117,330 A * 5/1992 Miazga ..... 361/760
5,155,663 A * 10/1992 Harase ..... 361/679.31
5,364,287 A * 11/1994 Weber ..... 439/358
5,711,558 A * 1/1998 Woody ..... 292/335
5,803,762 A * 9/1998 Green ..... 439/347
5,865,640 A * 2/1999 Tadokoro ..... 439/347
6,102,727 A * 8/2000 Kawaguchi et al. ..... 439/372
6,183,284 B1 * 2/2001 Gill et al. ..... 439/327
6,438,229 B1 * 8/2002 Overy et al. ..... 379/446
6,619,976 B2 * 9/2003 Huetter et al. ..... 439/352
6,703,630 B2 * 3/2004 Kurokawa ..... 250/492.22
6,729,897 B2 * 5/2004 Lai ..... 439/347
6,745,330 B1 * 6/2004 Maillot ..... 726/35
6,943,527 B2 * 9/2005 Liu et al. ..... 320/107
7,128,595 B2 * 10/2006 Boutros ..... 439/358
7,160,137 B1 * 1/2007 Yeh ..... 439/358
7,239,522 B2 * 7/2007 Rust et al. ..... 361/732
7,465,181 B1 * 12/2008 Bridges et al. ..... 439/358
7,484,991 B1 * 2/2009 Kelaher et al. ..... 439/372
7,578,691 B2 * 8/2009 Weksler et al. ..... 439/347
7,753,712 B2 * 7/2010 Miki ..... 439/353
7,976,072 B2 * 7/2011 Parrish ..... 285/312
8,083,535 B2 * 12/2011 Chang ..... 439/357
8,092,241 B2 * 1/2012 Chang ..... 439/305
8,371,870 B2 * 2/2013 Ma et al. ..... 439/347
2001/0008986 A1 * 7/2001 Brown et al. ..... 701/1
2003/0224637 A1 * 12/2003 Ling ..... 439/133
2006/0134962 A1 * 6/2006 Yeh ..... 439/352
2010/0151720 A1 * 6/2010 Lin ..... 439/358

* cited by examiner

*Primary Examiner* — Neil Abrams
*Assistant Examiner* — Phuongchi T Nguyen
(74) *Attorney, Agent, or Firm* — Berkeley Law & Technology Group, LLP

(57) ABSTRACT

The subject matter disclosed herein relates to an electrical connector that includes a locking mechanism to securely hold devices to the electrical connector.

5 Claims, 3 Drawing Sheets

LOCKABLE ELECTRICAL CONNECTOR

FIELD

The subject matter disclosed herein relates to an electrical connector that includes a locking mechanism to securely hold devices to the electrical connector.

BACKGROUND

USB (Universal Serial Bus) is an industry standard developed in the mid-1990s that defines cables, connectors, and protocols used for connection, communication, and power supply between computers and electronic devices.

USB was designed to standardize connections of computer peripherals, such as keyboards, pointing devices, digital cameras, printers, portable media players, disk drives, and network adapters to personal computers, both to communicate and to supply electric power. USB has become commonplace on other devices, such as smartphones, PDAs, and video game consoles, just to name a few examples. USB may be used to replace a variety of other interfaces, such as serial and parallel ports, as well as separate power chargers for portable devices.

BRIEF DESCRIPTION OF THE DRAWINGS

Non-limiting and non-exhaustive embodiments will be described with reference to the following objects, wherein like reference numerals refer to like parts throughout the various objects unless otherwise specified.

FIGS. 1A-1G illustrate perspective, side, and front views of a locking connector, according to one embodiment.

DETAILED DESCRIPTION

Figure 1:
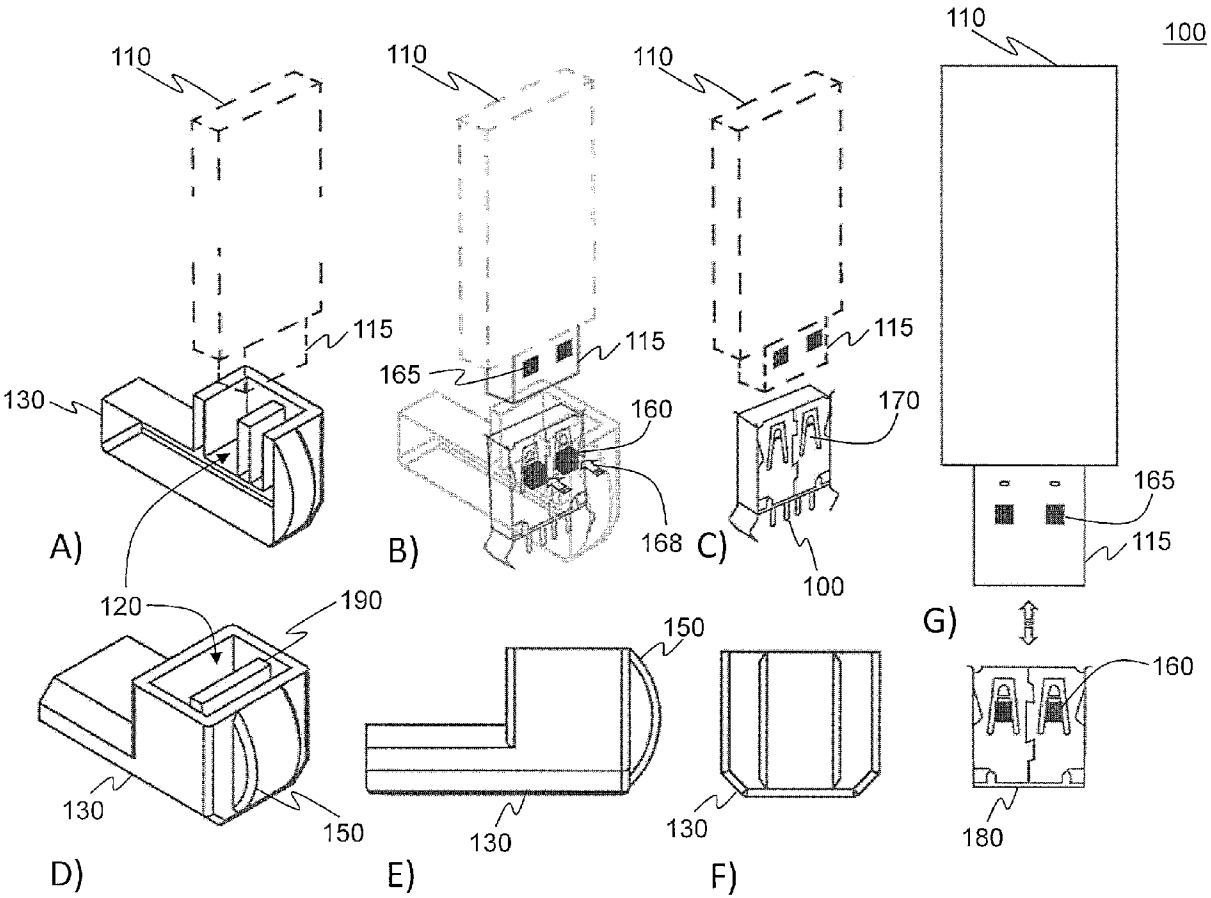
FIG. 1 includes perspective, front, and side views of a locking connector, according to an embodiment. Specifically.

In the following detailed description, numerous specific details are set forth to provide a thorough understanding of claimed subject matter. However, it will be understood by those skilled in the art that claimed subject matter may be practiced without these specific details. In other instances, methods, apparatuses, or systems that would be known by one of ordinary skill have not been described in detail so as not to obscure claimed subject matter.

Reference throughout this specification to "one embodiment" or "an embodiment" may mean that a particular feature, structure, or characteristic described in connection with a particular embodiment may be included in at least one embodiment of claimed subject matter. Thus, appearances of the phrase "in one embodiment" or "an embodiment" in various places throughout this specification are not necessarily intended to refer to the same embodiment or to any one particular embodiment described. Furthermore, it is to be understood that particular features, structures, or characteristics described may be combined in various ways in one or more embodiments. In general, of course, these and other issues may vary with the particular context of usage. Therefore, the particular context of the description or the usage of these terms may provide helpful guidance regarding inferences to be drawn for that context.

As used to describe such embodiments, terms "above", "below", "upper", "lower", "horizontal", "vertical", and "side" describe relative positions and/or directions that do not necessarily refer to a direction defined by gravity or any other particular orientation. Instead, such terms are merely used to identify one portion versus another portion. Accordingly, "upper" and "lower" may be equivalently interchanged with "top" and "bottom", "first" and "second", "right" and "left", and so on. "Horizontal" may refer to an orientation perpendicular to a particular axis while "vertical" may refer to an orientation parallel to the particular axis.

Embodiments described herein include a lockable electrical connector (LEC) that may provide a mechanism and/or may allow a process to lock or clamp an attached device to the electrical connector. An attached device, for example, may comprise a portable memory module, a USB power cord, a digital camera, a handheld communication device, a computer tablet, and so on. For example, an LEC may comprise terminals of one or more electrical conductors configured to electrically connect to mating electrical contacts of an attached device. An attached device may comprise a device electrically and/or physical connected to an LEC. Such electrical connection may involve contact among mating pairs of conductive terminals. Such physical connection may involve mechanical friction among portions of an attached device and an LEC (e.g., a "tight" or "snug" fit), and/or mechanical retainment of the attached device by displacing portions of the LEC during the attachment process, for example.

In one embodiment, an LEC may comprise a standard universal serial bus (USB) connector to connect or attach to any of a number of types of devices that include a USB plug. For example, an LEC may comprise a female USB portion to receive a male USB plug portion of a device to be attached to the LEC. In an implementation, such a standard USB connector and/or plug may be described in a number of publications, such as, for example, Universal Serial Bus Specification (revision 2.0, Apr. 27, 2000 or revision 1.0, Jun. 6, 2011, for example), known to one skilled in the art. Although other publications and/or standards may describe a USB connector and/or plug, hereinafter such a standard USB connector and/or plug will be inferred unless described otherwise. Though embodiments described herein may involve USB connectors and/or plugs, other connector/plug types may instead be involved, and claimed subject matter is not limited in this respect.

An LEC may operate using any of a number of techniques. In one implementation, a user may lock an attached device to an LEC by sliding a retaining element in a particular direction, whereas the user may unlock the device by sliding the retaining element in an opposite direction, for example. In another implementation, a user may lock an attached device to an LEC by rotating a knob or dial to initiate a particular mechanical motion, an example of which is described below. In still another implementation, a user may lock an attached device to an LEC by depressing a latch or button or rotating a lever to initiate still another particular mechanical motion, an example of which is also described below. In such implementations, as well as others, particular mechanical features of a plug of a device to be locked or clamped to an LEC may be utilized. For example, USB plugs may include holes in which pins or other protrusions from an LEC may be inserted to lock the USB plug (and the corresponding device) to the LEC, as explained in detail below.

FIGS. 1A-G include perspective, front, and side views of an LEC 130, according to an embodiment 100. For example, LEC 130 may comprise a USB LEC to connect to a device 110 having a USB plug 115, though claimed subject matter is not so limited. USB plug (or other type of plug) 115 may include holes 165. For example, holes 165 may comprise holes having quantity, sizes, positions, and/or orientations set forth by a USB specification, as described above. LEC 130 may comprise a body including spring tabs 170 and a cavity 120 comprising flange 190, which may also be set forth by a USB specification. Flange 190 may comprise a plurality of electrical connectors, such as pins or contacts, for example. Flange 190 may also be configured to prevent USB plug 115 from being inserted in a wrong direction or orientation, wherein mating conductors would not properly line up with one another. Spring tabs 170 may provide a spring force to retain plug 115 in cavity 120. For example, spring tabs 170 may at least partially protrude into holes 165 while plug 115 is plugged into cavity 120. Because removing plug 115 from cavity 120 may require spring tabs 170 to retract against a spring force from holes 165, a user may experience countering at least a portion of such a spring force to remove plug 115 from cavity 120, for example.

In one embodiment, LEC 130 may comprise one or more elements, such as pins 160 that may selectively prevent spring tabs 170 from retracting during a process of attempting to remove plug 115 from cavity 120. As described above, removing plug 115 from cavity 120 may require spring tabs 170 to retract from holes 165. Accordingly, to lock plug 115 to LEC 130, one or more pins 160 may prevent spring tabs 120 from being able to retract from holes 165. In one implementation, pins 160 may be locked in a position to be held against spring tabs 170, as indicated by arrows 168 in FIG. 1B, for example. In another implementation, pins 160 may apply a force against spring tabs 170 to push tabs 170 in a particular direction into holes 165, as indicated by arrows 168 in FIG. 1B, for example. Such a direction may be substantially perpendicular to a direction that USB plug 115 is received by cavity 120.

In one embodiment, a latch 150 may be depressed to lock and/or unlock pins 160 from a position of constraining spring tabs 170 from retracting out of holes 165. For example, plug 115 may automatically lock into cavity 120 merely upon insertion into space 120. Latch 150 may subsequently be used to release plug 115 from such a locked condition.

In another embodiment, LEC 130 need not include spring tabs 170. Accordingly, instead of constraining spring tabs 170 to remain in holes 165, one or more pins 160 may selectively protrude into holes 165 (and thus cavity 120). In other words, if USB plug 115 (or other type of plug) is plugged into cavity 120, pins 160 that selectively protrude into cavity 120 may also protrude into holes 165, thus locking USB plug 115 (and device 110) in a connected position with LEC 130. Arrows 168 in FIG. 1B show a direction that pins 160 may move to protrude into holes 165, for example. Such a direction may be substantially perpendicular to a direction that USB plug 115 is received by cavity 120. On the other hand, pulling pins 160 out of holes 165 may release USB plug 115 from a locked connected state with LEC 130, for example. In one implementation, latch 150 may be depressed or slid from one position to another to lock and/or retract pins 160 in a particular direction from their position in holes 165, for example. In an embodiment, one or more springs (not shown) may apply a force on pins 160 in a direction opposite such a particular direction. Such a spring force may apply a continuous force on pins 160 so that a user may experience a degree of resistance in depressing or sliding latch 150 to release USB plug 115 by retracting pins 160, for example. In another embodiment, latch 150 may comprise a knob to rotate in a particular direction to release USB plug 115 from a locked engagement with LEC 130. Such a knob may be rotated from one position to another to lock and/or retract pins 160 in a particular direction from their position in holes 165, for example. One or more springs may apply a torque on pins 160 in a direction opposite such a particular direction. Such a spring torque may apply a continuous force on pins 160 so that a user may experience a degree of resistance in rotating a knob to release USB plug 115 by retracting pins 160, for example.

In a particular implementation, pins 160, which may be spring-loaded, may be displaced by insertion of USB plug 115. For example, as USB plug 115 enters cavity 120, a portion of USB plug 115 may apply a force on pins 160 (e.g., counter to a spring force imparted on spring-loaded pins 160) by contacting a portion of pins 160. Upon or after USB plug 115 enters cavity 120 by at least a particular distance, spring-loaded pins 160 may encounter holes 165. Consequently, spring-loaded pins 160 may plunge into holes 165, thus locking USB plug 115 in cavity 120. As mentioned above, a mechanism such as latch 150 may be used to subsequently release USB plug 115 from such a locked state, for example. Of course, such details of an LEC are merely examples, and claimed subject matter is not so limited.

Figure 2:
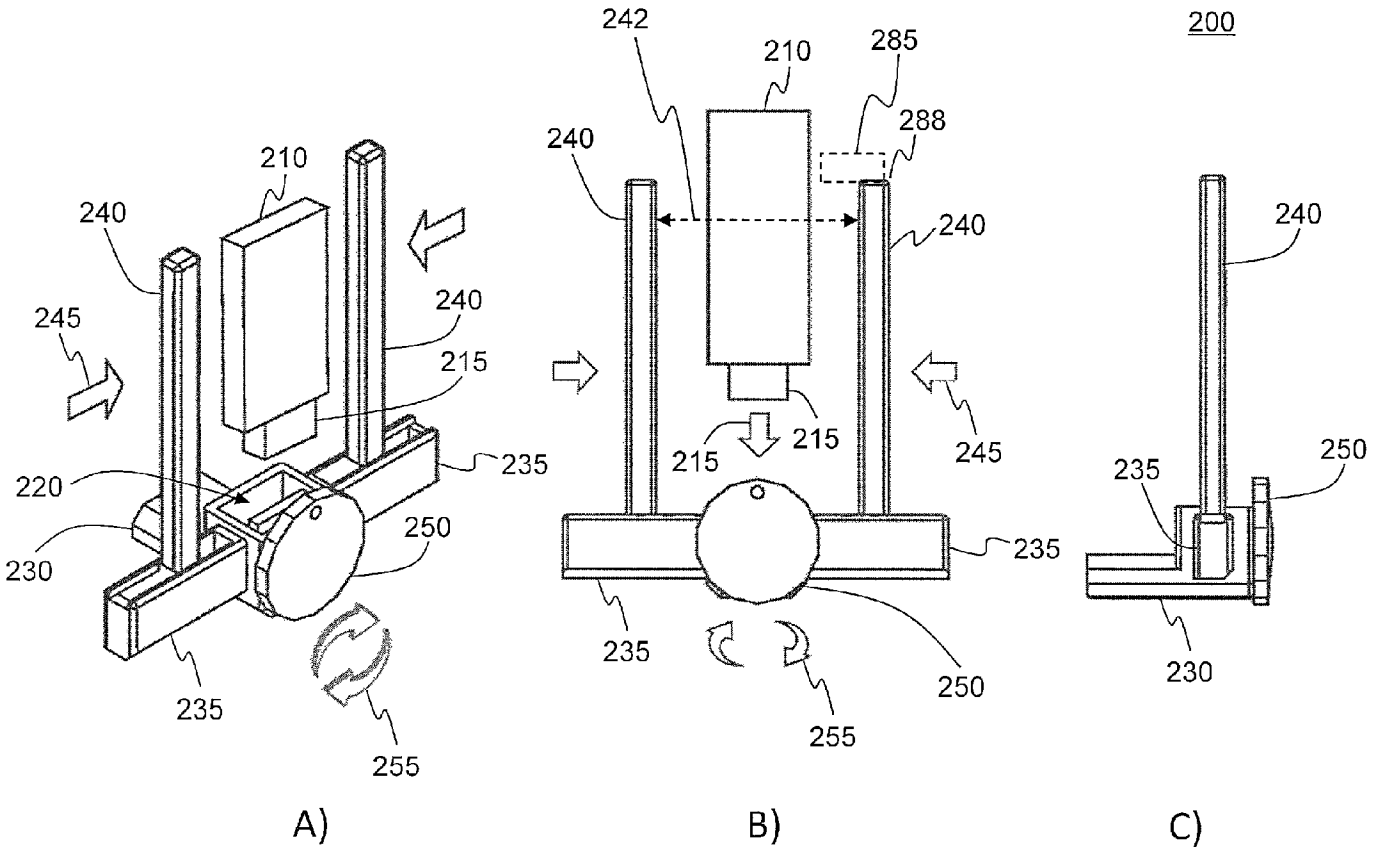
FIG. 2 includes perspective, front, and side views of a locking connector, FIGS. 2A-2C, respectively, according to another embodiment.

FIG. 2 includes perspective, front, and side views, FIGS. 2A-2C, respectively, of an LEC 230, according to an embodiment 200. For example, LEC 230 may comprise a USB connector that is able to lock a USB plug 215 of device 210 in a connected position. Device 210 may comprise a portable memory module, a USB power cord, a digital camera, a handheld communication device, or a computer tablet, just to name a few examples. LEC 230 may comprise a body including a receptacle 220 configured to receive plug 215 of device 210 for connecting mating electrical terminals of plug 215 and receptacle 220. LEC 230 may also include one or more arms 240 that are moveable or translatable along guides 235 in response to activation of a driving mechanism to apply a force or torque to the arms. For example, rotation of a knob 250 or other type of adjustable element may lead to translation of arms 240 to clamp or release device 210. In other words, a distance 242 between two arms 240 may change in response to rotation of knob 250 or other driving mechanism. As an illustrative example shown in FIGS. 2A and 2B, knob 250 may be rotated as indicated by arrows 255 to moves arms 240 toward one another, as indicated by arrows 245. Rotating knob 250 clockwise (or counter-clockwise) may move arms 240 toward one another to hold device 210 in a particular (e.g., locked) position. On the other hand, rotating knob 250 counter-clockwise (or clockwise) may move arms 240 away from one another to release device 210 from such a particular (e.g., locked) position. Of course, such details of a driving mechanism are merely examples, and claimed subject matter is not so limited.

Arms 240 may be shaped or contoured so as to improve their ability to hold device 210. Further, arms 240 may comprise a resilient material to improve their ability to hold device 210. For example, rubber-like material may provide a gripping ability beyond that of rigid plastic. In one implementation, arms 240 may have a shape that conforms or corresponds to a shape of device 210. For example, arms 240 may include a curve or projection 285 at end portion 288 to at least partially cover an upper portion of device 210. Of course, such details of an LEC are merely examples, and claimed subject matter is not so limited.

Figure 3:
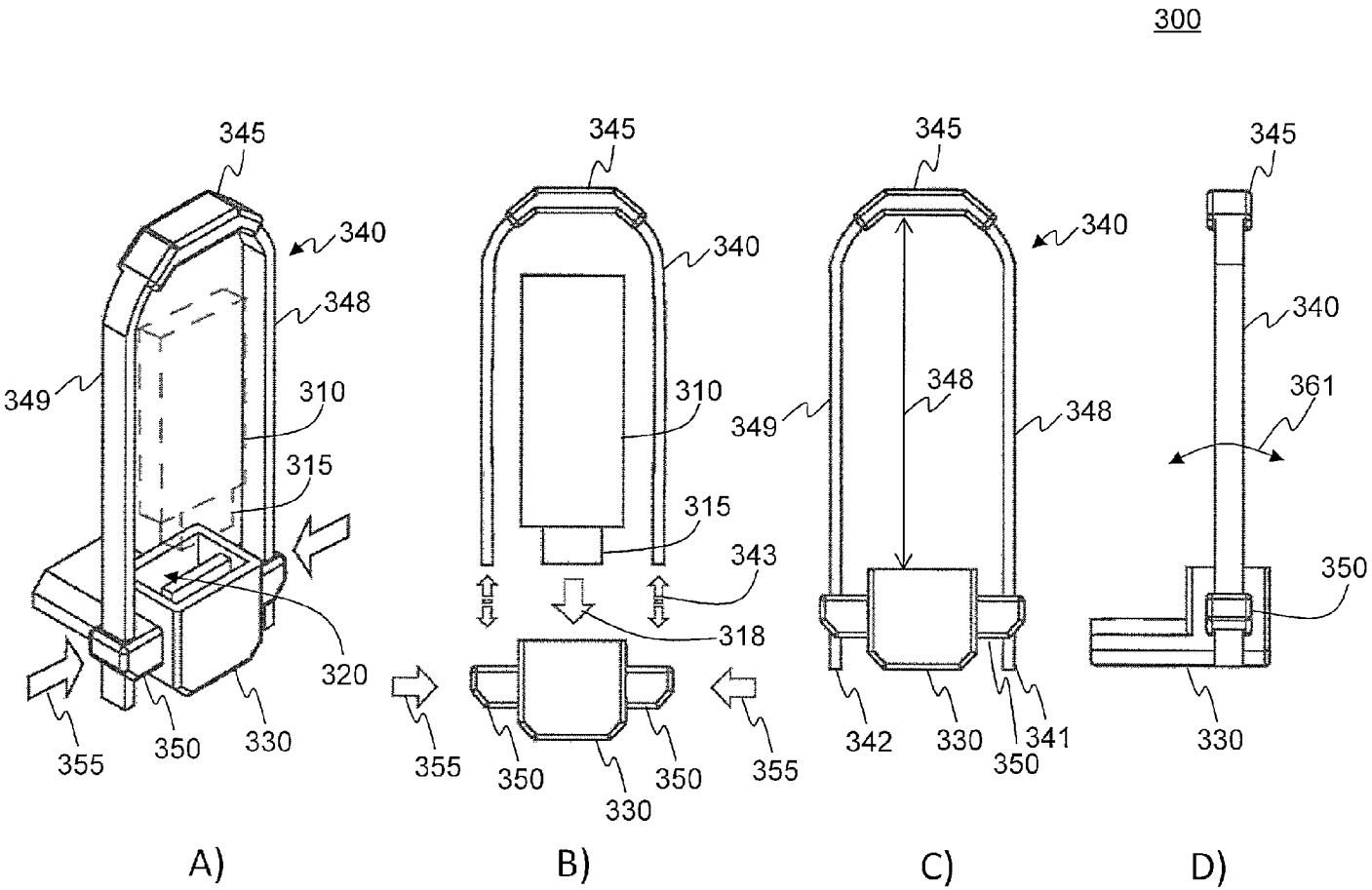
FIG. 3 includes perspective (FIG. 3A), front (FIGS. 3B and 3C), and side (FIG. 3D) views of a locking connector, according to still another embodiment.

FIG. 3 includes perspective, front, and side views, FIGS. 3A-3D, of an LEC 330, according to an embodiment 300. For example, LEC 330 may comprise a USB connector that is able to lock a USB plug 315 of device 310 in a connected or locked position. LEC 330 may comprise a body including a receptacle 320 configured to receive plug 315 of device 310 for connecting mating electrical terminals of plug 315 and receptacle 320. For example, arrow 318 in FIG. 3B indicates a direction that plug 315 may be inserted into receptacle 320. LEC 330 may also include a bracket 340 that may be slidable through slotted tabs 350 in response to depressing slotted tabs 350 in a direction indicated by arrows 355 in FIGS. 3A and 3B, for example.

In one embodiment, bracket 340 may be substantially U-shaped and may comprise one or more members, such as a first vertical portion 348 including a first end 341, a second vertical portion 349 including a second end 342, and a top distal portion 345. Of course, as mentioned above, terms such as "vertical" or "top" are relative, and are not intended to necessarily be used with respect to a direction of gravity, for example. Whether bracket 340 comprises a single member or multiple members, bracket 340 need not have a U-shape. For example, bracket 340 may be substantially U-shaped having one or more curved or flattened portions to deviate from a U-shape. In one implementation, bracket 340 may be substantially "V"-shaped, for example, though claimed subject matter is not limited in this respect.

A distance 348 between distal portion 345 of bracket 340 and LEC 330 may be adjusted by sliding bracket 340 in directions indicated by arrows 343 in FIG. 3B, for example. Decreasing distance 348 so as to bring at least a portion (e.g., portion 345) in contact with at least a portion of device 310 may lead to device 310 (and plug 315) being in a locked (e.g., clamped) state with LEC 330.

In one implementation, slotted tabs 350 may be connected to an internal structure of LEC 330 involving springs. Accordingly, a compressive spring force may be encountered by a user upon depressing slotted tabs 350. On the other hand, slotted tabs 350 may spring back to an outward position after a user lets go (e.g., releases) slotted tabs 350. Bracket 340 may be slidable in a direction indicated by arrows 343 while slotted tabs 355 are depressed. On the other hand, bracket 340 may be locked in a particular position while slotted tabs 355 are not depressed (e.g., released), for example.

In one implementation, LEC 330 may utilize a ratcheting technique. For example, slotted tabs 350 need not be depressed to slide bracket 340 in one direction. For example, distance 348 may be decreased by sliding bracket 340 in one direction. On the other hand, slotted tabs 350 may need to be depressed to slide bracket 340 in an opposite direction. Accordingly, device 310 may be locked in position by pushing bracket 340 in a direction so as to contact and hold device 310. On the other hand, device 310 may be unlocked by depressing slotted tabs 350 in a direction indicated by arrows 355, thus allowing bracket 340 to be able to slide away from device 310.

Distal portion 345 may be shaped or contoured so as to improve an ability to hold device 310. Further, distal portion 345 may comprise a resilient material to improve its ability to hold device 310. For example, rubber-like material may provide a gripping ability beyond that of rigid plastic.

In one implementation, slotted tabs 350 and bracket 340 may be rotateable with respect to receptacle 320, as indicated by arrow 361, for example. Such rotate-ability may allow for any of a number of shapes of device 310. Of course, such details of an LEC are merely examples, and claimed subject matter is not so limited.

One skilled in the art will realize that a virtually unlimited number of variations to the above descriptions is possible, and that the examples and the accompanying figures are merely to illustrate one or more particular implementations.

The terms, "and," "and/or," and "or" as used herein may include a variety of meanings that also is expected to depend at least in part upon the context in which such terms are used. Typically, "or" as well as "and/or" if used to associate a list, such as A, B or C, is intended to mean A, B, and C, here used in the inclusive sense, as well as A, B or C, here used in the exclusive sense. In addition, the term "one or more" as used herein may be used to describe any feature, structure, or characteristic in the singular or may be used to describe some combination of features, structures, or characteristics. Though, it should be noted that this is merely an illustrative example and claimed subject matter is not limited to this example.

While there has been illustrated and described what are presently considered to be example embodiments, it will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular embodiments disclosed, but that such claimed subject matter may also include all embodiments falling within the scope of the appended claims, and equivalents thereof.

What is claimed is:

1. A Universal Serial Bus (USB) connector comprising:

a body including a USB receptacle to receive a USB plug of a device;

one or more arms that are translatable to clamp/release said USB plug in said USB receptacle by holding/releasing said device in/from a particular position; and a driving mechanism to apply a force or torque to translate at least one of said one or more arms;

wherein said driving mechanism comprises a knob, wherein said one or more arms comprise two arms, and wherein a distance between said two arms changes in response to rotation of said knob; and wherein said knob is rotateable in a first direction to release said USB plug from said USB receptacle and is rotateable in a direction opposite said first direction to lock said USB plug in said receptacle.

2. The USB connector of claim 1, further comprising a resilient material disposed on said one or more arms, said resilient material to contact said device while said device is in said particular position.

3. The USB connector of claim 1, wherein said device comprises a memory module.

4. An USB connector comprising:

a body including a USB receptacle to receive a USB plug of a device;

a U-shaped bracket having a first end slideably disposed in a first slotted tab and a second end slideably disposed in a second slotted tab, wherein said first and second slotted tabs respectively protrude from opposite sides of said body, and wherein said U-shaped bracket is slidable to clamp/release said USB plug in said USB receptacle by holding/releasing said device in/from a particular position;

wherein said first and second slotted tabs are depressable with respect to said body, and wherein said U-shaped bracket is locked or unlocked in a slidable position based, at least in part, on whether said first and/or second slotted tabs are depressed toward said body; and wherein a distance between a distal end of said U-shaped bracket and said USB receptacle changes in response to sliding said U-shaped bracket through said first and second slotted tabs.

5. The USB connector of claim 4, wherein said U-shaped bracket and said first and second slotted tabs are together rotatable with respect to said USB receptacle.

* * * * *